US005441818A

United States Patent [19]

Kadokura

[11] Patent Number: 5,441,818

[45] Date of Patent: Aug. 15, 1995

[54] ELECTRO-DEPOSITION COATED MEMBER, PROCESS FOR PRODUCING ELECTRO-DEPOSITION COATED MEMBER, AND ELECTRO-DEPOSITION COATING USE THEREFOR

[75] Inventor: Susumu Kadokura, Sagamihara, Japan

[73] Assignee: Canon Kabushiki Kaisha, Tokyo, Japan

[21] Appl. No.: 370,840

[22] Filed: Jan. 10, 1995

Related U.S. Application Data

[60] Continuation of Ser. No. 61,050, May 14, 1993, which is a division of Ser. No. 611,651, Nov. 13, 1990, Pat. No. 5,238,544.

[30] Foreign Application Priority Data

Nov. 14, 1989 [JP] Japan ..... 1-296786

[51] Int. Cl.[6] ..... B22F 7/04

[52] U.S. Cl. ..... 428/551; 428/553; 428/565; 428/618

[58] Field of Search ..... 428/551, 553, 565, 618

[56] References Cited

U.S. PATENT DOCUMENTS 5,283,116 2/1994 Tomari et al. ..... 428/323

*Primary Examiner*—Donald P. Walsh
*Assistant Examiner*—John N. Greaves
*Attorney, Agent, or Firm*—Fitzpatrick, Cella, Harper & Scinto

[57] ABSTRACT

An electro-deposition coated member comprises a substrate having thereon an electro-deposition coating film. The electro-deposition film contains a powder comprising a ceramic powder having an average particle diameter of from 0.1 to 5 μm, the particle surfaces of which are coated with a metal, in an amount of from 5 to 50 parts by weight based on 100 parts by weight of the electro-deposition coating film. The electro-deposition coated member can be produced by a process comprising the steps of; subjecting a substrate to electro-deposition coating in a coating composition containing a resin feasible for electro-deposition and a powder comprising a ceramic powder having an average particle diameter of from 0.1 to 5 m, the particle surfaces of which are coated with a metal, the powder being contained in an amount of from 0.2 to 30 parts by weight based on from 100 to 150 parts by weight of the resin feasible for electro-deposition; and subsequently carrying out low-temperature curing.

20 Claims, 2 Drawing Sheets

ELECTRO-DEPOSITION COATED MEMBER, PROCESS FOR PRODUCING ELECTRO-DEPOSITION COATED MEMBER, AND ELECTRO-DEPOSITION COATING USE THEREFOR

This application is a continuation of application Ser. No. 08/061,050, filed May 14, 1993, which is a division of application Ser. No. 07/611,651, filed Nov. 13, 1990, now U.S. Pat. No. 5,238,544 issued Aug. 24, 1993.

BACKGROUND OF THE INVENTION

1. Field of the Invention

The present invention relates to an electro-deposition coating composition and an electro-deposition coated member, suited for improving electromagnetic wave shielding effect of optical instruments such as cameras, home electric appliances, or plastic molded housing for office automation machinery, etc.

2. Related Background Art

In recent years, it has been required for cases of electronic machinery to be treated for electromagnetic wave shielding so that electronic machinery can be prevented from misoperation due to electromagnetic wave obstacles. Under such circumstances, as disclosed, for example, in Japanese Patent Application Laid-open No. 59-223763, spray coating making use of a conductive coating material in which a conductive filler is included is prevailing as a method of shielding electromagnetic waves. Other methods are also used, which include zinc spray coating, electroless plating, vacuum deposition and conductive plastic coating.

The conventional methods, however, have the following disadvantages.

The conductive coating material can achieve no sufficient electromagnetic wave shielding effect unless the conductive filler is contained in an amount of not less than 60 parts by weight, and moreover has a coating thickness of not less than 30 μm in the case of a copper filler and not less than 50 μm in the case of a nickel filler. For this reason, it is not suitable for decorative coating of a housing.

The spray coating results in a non-uniform coating thickness when applied to a housing complicated in shape, and also has problems in electromagnetic wave shielding properties and appearance.

As for the zinc spray coating, it gives a coating thickness of as large as from 50 to 100 μm, and also has a difficulty in adhesion properties. For this reason, it becomes necessary to provide steps for blast finishing, etc. In addition, there is still a problem in mass productivity because of a work environment worsened by zinc vapor gas.

In regard to the electroless plating, the whole housing is plated and therefore the exterior of the housing must be subjected to decorative coating on account of appearance. In order to carry out the coating on the surface of the plated housing, a special coating solution must be used since an ordinary spray coating material has such poor adhesion properties between the film surface formed by plating and the coating surface formed by coating that commercial values are lowered. This greatly affects cost and can not be mass-productive.

SUMMARY OF THE INVENTION

The present invention was made taking account of the above problems. An object of the present invention is to provide an electro-deposition coated member having an electro-deposition coating film that can reduce in half the filler content and coating thickness in the conventional conductive coating, have settled the adhesion properties and uniformity of coating films, has high shielding properties, and also can be well applied as decorative coating.

Another object of the present invention is to provide a process for producing an electro-deposition coated member having an electro-deposition coating film with superior properties of adhesion to substrates, superior uniformity, and high shielding properties.

A further object of the present invention is to provide an electro-deposition coating composition used to form an electro-deposition coating film with superior properties of adhesion to substrates, superior uniformity, and high shielding properties.

The electro-deposition coated member of the present invention is an electro-deposition coated member comprising a substrate having thereon an electro-deposition coating film, wherein a powder comprising a ceramic powder having an average particle diameter of from 0.1 to 5 μm whose particle surfaces are coated with a metal is contained in said electro-deposition coating film in an amount of from 5 to 50 parts by weight based on 100 parts by weight of the electro-deposition coating film.

The process of the present invention for producing an electro-deposition coated member is a process comprising the steps of:

subjecting a substrate to electro-deposition coating in a coating composition comprising a resin feasible for electro-deposition and a powder comprising a ceramic powder having an average particle diameter of from 0.1 to 5 μm whose particle surfaces are coated with a metal, said powder being contained in an amount of from 0.2 to 30 parts by weight based on from 100 to 150 parts by weight of said resin feasible for electro-deposition; and subsequently carrying out low-temperature curing.

The electro-deposition coating composition of the present invention is an electro-deposition coating composition comprising a resin feasible for electro-deposition and a powder comprising a ceramic powder having an average particle diameter of from 0.1 to 5 μm whose particle surfaces are coated with a metal, said powder being contained in an amount of from 0.2 to 30 parts by weight based on from 100 to 150 parts by weight of said resin feasible for electro-deposition.

The powder comprising a ceramic powder whose particle surfaces are metal-plated is codeposited in a coating film. Hence, not only the shielding properties can be improved but also the curing reaction can be so perfectly carried out even at a low temperature (e.g., 100° C.) that, in respect of physical properties, the resulting coating film can also have physical properties which are substantially the same as or superior to those of a high-temperature cured film.

In Surface Technique Association, The 80th Lecture Meeting Summary Collections, page 144, published Sep. 10, 1989, the present inventor has reported that ceramic particles may be codeposited when an electro-deposition coating film is formed on a plastic substrate whereby an electro-deposition coating film with good physical properties can be obtained even when the electro-deposition coating is cured at a low temperature. The present inventor made further studies so that electromagnetic wave shielding properties could be imparted to the electro-deposition coating film. As a result, the inventor has discovered an electro-deposition coating film that satisfies both the physical properties of a coating subjected to low-temperature curing and the electromagnetic wave shielding properties, and thus accomplished the present invention.

DESCRIPTION OF THE PREFERRED EMBODIMENTS

The present invention will be described below in detail with reference to the accompanying drawings.

Figure 1:
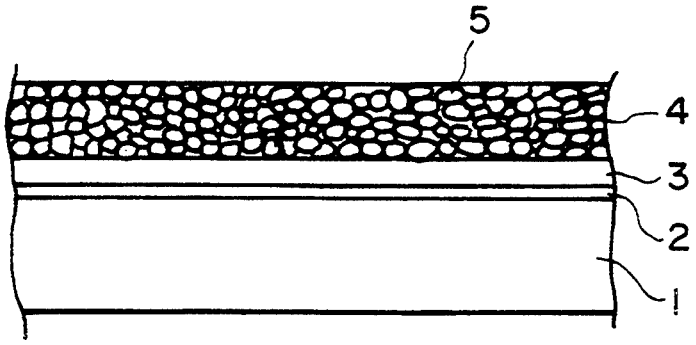
FIG. 1 is a partial cross section of the electro-deposition coated member according to an embodiment of the present invention.

FIG. 1 is a partial cross section of the electro-deposition coated member according to an a embodiment of the present invention in which the commonly known plating on a plastic is carried out on an ABS resin 1 to form a catalytically treated layer 2 and a metal coating layer 3, thus giving a base material, and an electro-deposition coating film 4 is formed thereon.

In the present invention, the electro-deposition coating film 4 is formed by code position of: a resin feasible for electro-deposition and a ceramic powder 5 whose particle surfaces are coated with a metal (hereinafter "metallized ceramic powder") by electro-deposition coating.

Resins conventionally used in electro-deposition coating can be used as the resin feasible for electro-deposition of the present invention, including, for example, acrylic melamine resins, acrylic resins, epoxy resins, urethane resins and alkyd resins.

The particle diameter of the ceramic powder used in the metallized ceramic powder to be deposited together with the resin depends on the purpose of the electro-deposition coating film formed as for example, on the degree to which its appearance is satin-finished. Considering the shielding properties of the coating film, the ceramic powder should have an average particle diameter of from 0.1 to 5 μm, and particularly preferably from 0.5 to 2 μm, in order to increase the contact surface areas between particles of the metallized ceramic powder. This average particle diameter of the ceramic powder can be measured using a particle size distribution measuring apparatus of a centrifugal sedimentation type.

In the present invention, the ceramic powder includes aluminum oxide, titanium nitride, manganese nitride, tungsten nitride, tungsten carbide, lanthanum nitride, aluminum silicate, molybdenum disulfide, titanium oxide, graphite powder, and silicate compound powder.

The particle surfaces of the ceramic powder can be plated preferably using nickel, copper or the like in view of shielding properties. Formation of coatings on the particle surfaces of the ceramic powder may preferably be carried out by electroless plating. It is possible to obtain good shielding properties, and also good properties of a coating film subjected to low-temperature curing, when the coatings on the particle surfaces of the metallized ceramic powder thus formed are controlled to a thickness of from 0.05 to 3 μm, and particularly from 0.15 to 2 μm.

The electro-deposition coating solution used in the present invention can be obtained by dispersing the above metallized ceramic powder and the resin feasible for electro-deposition by means of a ball mill, and then diluting the dispersion with desalted water so as to give a concentration of from 10 to 15 parts by weight as solid contents. It is possible to obtain an electro-deposition coating film with superior shielding properties and decorativeness, when the electro-deposition coating composition of the present invention is an electro-deposition coating composition containing the metallized ceramic powder in an amount of from 0.2 to 30 parts by weight, and particularly from 10 to 20 parts by weight, based on from 100 to 150 parts by weight of the resin feasible for electro-deposition.

The process for producing the electro-deposition coated member of the present invention will be described below.

First, plating, i.e., decorative etching is applied to the plastic substrate 1, and thereafter electroless plating is applied to give a coating of from 3 to 10 μm. Plating materials usable here include, for example, nickel and copper. Next, the coating thus formed by this plating is subjected to chemical chromate treatment, followed by electro-deposition coating in the electro-deposition coating composition described above.

The electro-deposition coating may be carried out by, for example, using the electro-depositing article as an anode in the case of an anionic system or as a cathode in the case of a cationic system. At this time, the electrolysis may preferably be carried out under conditions of a bath temperature ranging from 20° to 25° C., an applied voltage of from 50 to 200 V, a current density of from 0.5 to 3 $A/dm^2$, and a treating time of from 1 to 5 minutes.

Subsequently, after having been washed with water, the resulting coating is baked in an oven at a low temperature for 20 to 180 minutes to effect curing. The electro-deposition coated member of the present invention can be thus obtained. Here, the baking may preferably be carried out at a temperature of not higher than 100° C., and particularly between 90° C. and 100° C.

The amount of codeposition of the metallized ceramic powder after curing may preferably be controlled in the range of from 5 to 50 parts by weight, and particularly from 10 to 30 parts by weight, based on 100 parts by weight of the electro-deposition coating film so that a condition of from 40 to 50 dB for attenuation can be satisfied in the electromagnetic wave shielding properties and also the coating film properties such as the decorativeness of an electro-deposition coating film, the adhesion to a substrate of a coating subjected to low-temperature curing and the wear resistance can be improved. An amount of codeposition which is more than 50 parts by weight may make a coating film brittle after curing, tending to cause cracking. On the other hand, an amount thereof less than 5 parts by weight makes it impossible to obtain sufficient shielding properties, and also makes it impossible to achieve satisfactory curing in the baking at a low temperature and to obtain superior coating film properties.

In the present invention, the electro-deposition coating film may preferably have a thickness of from 10 to 30 μm, and particularly from 15 to 25 μm, taking account of the shielding properties, the coating film properties and the uniformity required in external coating.

As materials used for the substrate 1 in the present invention, metals or plastics can be used. The present invention can be particularly effective where a plastic unfeasible for heating at a high temperature is used as the substrate, since the electro-deposition coating film of the present invention can achieve superior coating film properties such as adhesion properties, wear resistance and solvent resistance even when baked at a low temperature.

The plastic substrate used in the present invention includes, for example, ABS resin substrates, polycarbonate resin substrates, and polyether imide substrates.

As described above, in the present invention, the ceramic powder whose particle surfaces are plated with a metal is dispersed in a coating composition and deposited on a substrate together with a resin by electrophoresis. Thus, the coating film can be filled with the metallized ceramic powder in a high density, the contact areas between metallized ceramic powder particles can be enlarged, the same shielding effect as those in electroless plating can be obtained, and also the same coating film properties as those of a high-temperature cured coating film can be obtained. The present invention is also suited as decorative coating. It can also be effective for shielding electromagnetic waves from the outside.

According to the present invention, the two steps of decoratively coating a substrate and imparting electromagnetic wave shielding properties can be simultaneously carried out in one operation of the electro-deposition coating, so that an electromagnetic wave shielding member can be produced more efficiently than in any conventional shielding processes.

According to the present invention, the coating film with superior physical properties can be obtained even by low-temperature curing, and hence the electro-deposition coating film with shielding properties can be formed also on a plastic having a low thermal resistance.

Since the step of decorative coating and the step of imparting shielding properties can be carried out at the same time, the present invention can be particularly effective for the coating of a housing or the like of electronic machinery.

The present invention will be described below in greater detail by giving Examples.

EXAMPLE 1

On an ABS resin substrate, electroless Ni-plating was applied to Give a coating with a thickness of 3 μm, which was further subjected to chromate treatment, and then on the substrate thus treated, an electro-deposition coating film was formed. Here, an electro-deposition coating composition was prepared by dispersing in 100 parts by weight of an acrylic melamine resin 10 parts by weight of a powder comprising alumina with an average particle diameter of 0.5 μm whose particle surfaces were plated with nickel by electroless plating in a thickness of 0.15 μm, and then diluting the resulting dispersion with desalted water so as to give a concentration of 15 parts by weight as the solid contents.

In the resulting electro-deposition coating composition, the above substrate was immersed and an electric current was applied for 3 minutes at a bath temperature of 20° C. and at an applied voltage of 120 V to carry out electro-deposition coating. After being washed with water, the coating thus formed was baked in an oven at a temperature of 97° C.±1° C. for 60 minutes to effect curing. An electro-deposition coated member comprising the substrate having thereon an electro-deposition coating film with a thickness of 20 μm was thus obtained.

Using as the electro-deposition coating composition a coating composition in which the metallized alumina was dispersed in an amount of 20 parts by weight or a coating composition in which no metallized alumina was dispersed, electro-deposition coating was also carried out under the same conditions as the above to give the corresponding electro-deposition coated members.

Figure 2:
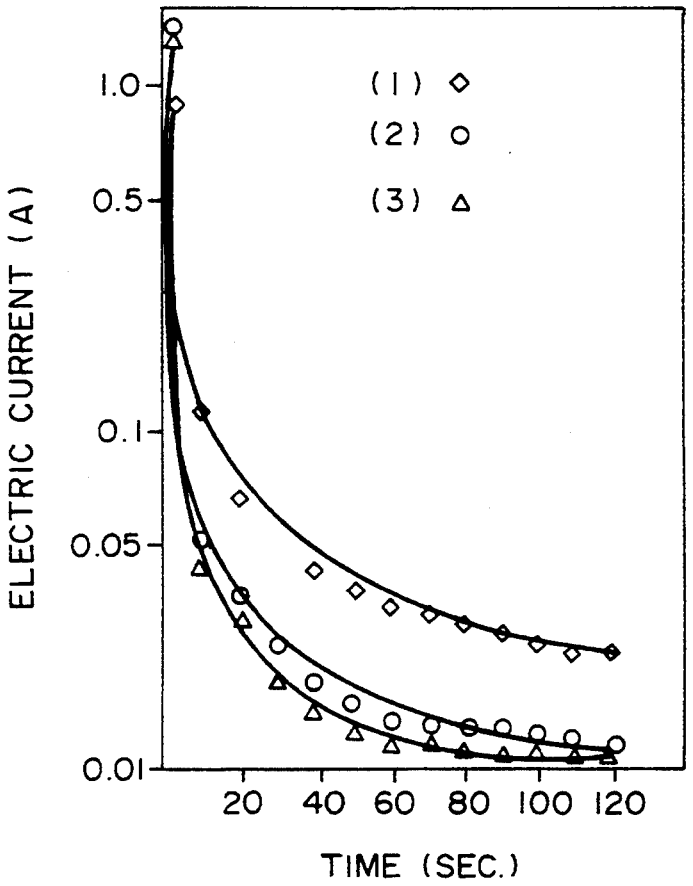
FIG. 2 shows current-time curves of a composition in which a powder comprising a ceramic powder whose particle surfaces have been metal-plated is dispersed, and a composition containing only a resin.

FIG. 2 shows current-time curves of the respective electro-deposition coating composition herein used. In FIG. 2, the parenthesized numeral 1 concerns the electro-deposition coating composition containing only the resin; the parenthesized numeral 2, the coating composition containing 10 parts by weight of the metallized ceramic powder; and the parenthesized numeral 3, the coating composition containing 20 parts by weight of the metallized ceramic powder. The results show that, compared with the composition containing only the resin, the electric current abruptly attenuates with time in each solution in which the ceramic powder whose particle surfaces have been metal-plated is dispersed, evidencing that the coating film thus deposited has a high denseness.

The amounts of codeposition in the electro-deposition coating films containing the powder, thus formed, were 20 parts by weight and 30 parts by weight, respectively.

Next, in respect of the latter electro-deposition coated member, measurement was made of its electromagnetic wave shielding effect. As a result, it showed an attenuation of 90 dB, as denoted by the parenthesized numeral 3 in FIG. 3.

Evaluation was also made on the adhesion properties of this electro-deposition coating film to the substrate, wear resistance, weathering resistance, moisture resistance, and hardness. Results obtained are shown in Table 1.

The evaluation of the shielding properties was made according to the transmission line method. The evaluation on the adhesion properties to the substrate and on the weathering resistance was made according to JIS K-5400, and the moisture resistance, according to JIS K-2246.

The hardness was evaluated on the basis of pencil hardness. The wear resistance was evaluated by measuring the number of times by which the coating film surface had to be rubbed with a rubber under a load of 350 g until the substrate was exposed to the surface.

The average particle diameter of the ceramic powder is a value measured using a particle size distribution measuring apparatus of a centrifugal sedimentation type (trade name: SACP-3; manufactured by Shimadzu Corporation).

Reference Example 1

As a reference example concerning the electromagnetic wave shielding properties of the electro-deposition coated member of the present invention, comprising the metallized ceramic powder codeposited, nickel was formed in a thickness of 0.4 μm on an ABS resin substrate by electroless plating, and subsequently copper in a thickness of 0.7 μm. Using the resulting member, the electromagnetic wave shielding effect was measured in the same manner as in Example 1. Results obtained are as denoted by the parenthesized numeral 2 in FIG. 3.

Reference Example 2

As a reference example concerning the electromagnetic wave shielding properties of the electro-deposition coated member of the present invention, nickel was formed in a thickness of 3 μm on an ABS resin substrate by electroless plating. Using the resulting member, the electromagnetic wave shielding effect was measured in the same manner as in Example 1. Results obtained are as denoted by the parenthesized numeral 3 in FIG. 3.

As shown in Table 1, the electro-deposition coating film of the present invention is seen to have superior coating film properties as a coating film used for exterior coating.

Figure 3:
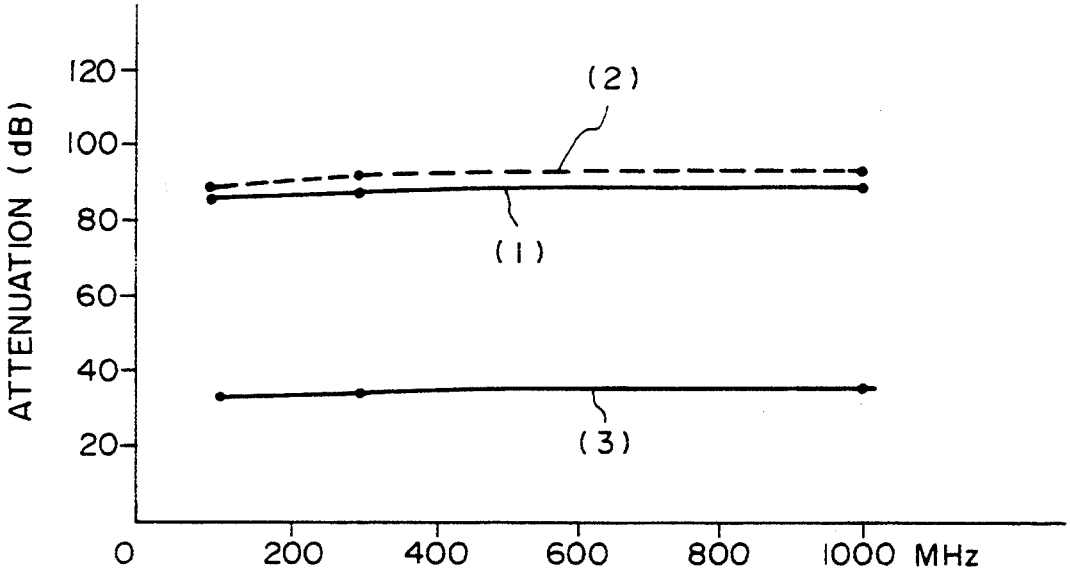
FIG. 3 shows comparison of shielding effects.

It is also seen from FIG. 3 that the electro-deposition coated member of the present invention has substantially the same shielding properties as the member coated by electroless copper plating which is a convention shielding method, shown in Reference Example 1.

electro-deposition was carried out for 3 minutes under conditions of a bath temperature of 25° C., a pH of from 8 to 9, using the article to be coated as an anode and a 0.5 t stainless steel as the opposite electrode, and at an applied voltage which was raised by 50 V in the range of from 50 to 150 V.

After completion of electro-deposition, the coatings formed were washed with water, and then cured in an oven of 97° C.±1° C. for 60 minutes. Three kinds of electro-deposition coated members were thus obtained, each having an electro-deposition coating film of 20 μm thick.

The amount of codeposition contained in 100 parts by weight of each electro-deposition coating film was measured using a thermogravimetric analyzer (manufactured by Perkin-Elmer Co.) to reveal that it was 5 parts by weight, 25 parts by weight and 50 parts by weight, respectively.

Next, the respective members were evaluated on their electromagnetic wave shielding effects and coating film properties in the same manner as in Example 1. Results obtained are shown in Table 2.

TABLE 1

| | Amount of codeposition (pbw) | Shielding properties (dB) | Coating film properties: Adhesion properties (points) | Wear resistance (times) | Weathering resistance | Moisture resistance (hrs) | Hardness |
|---|---|---|---|---|---|---|---|
| Example 1: | 20 | 60 | 10 | 800 | No changes after 600 hrs | 350 | 3H |
| | 30 | 90 | 10 | 800 | No changes after 600 hrs | 350 | 4H |

In the present invention, coating films satisfying the following conditions were judged as coating films having good shielding properties and coating film properties.
Shielding properties: Attenuation of 40 dB or more
Adhesion properties: 8 points or more
Wear resistance: 700 times or more
Weathering resistance: No changes for 600 hours or more
Moisture resistance: No changes for 350 hours or more
Hardness 3H or more

EXAMPLES 2 TO 4

Based on 100 parts by weight of an acrylic melamine resin (trade name: Honey Bright C-IL; produced by Honey Chemical Co.), 0.5 part by weight, 15 parts by weight and 30 parts by weight each of a powder comprising alumina with an average particle diameter of 1 μm whose particle surfaces were subjected to electroless nickel plating in a thickness of 2 μm was added. These were dispersed using a ball mill, and thereafter the dispersion was diluted with desalted water so that the acrylic melamine resin end the metallized alumina to be contained in an amount of 15 parts by weight, followed by further addition of 2 parts by weight of carbon black for the purpose of coloring. Three kinds of electro-deposition coating compositions were thus prepared.

As an article on which the electro-deposition coating film is formed, an ABS resin sheet of 100 mm×100 mm in size was used. This ABS resin sheet was treated with a $CrO_3$—$H_2SO_4$—$H_2O$ etchant for 1 minute, followed by treatment with a sensitizer solution comprising a mixture of 30 g/lit of stannous chloride and 20 ml/lit of hydrochloric acid, at room temperature for 2 minutes, then catalytic treatment with palladium, then electroless nickel plating in a thickness of 3 μm, and then treatment with 0.01 g/lit of chromic anhydride for 1 minute. Tests pieces were thus prepared.

Subsequently, the test pieces were immersed in the above electro-deposition coating composition, respectively, to carry out electro-deposition coating. The Comparative Examples 1 to 3

Three kinds of electro-deposition coating compositions were prepared in the same manner as in Example 2 except that the metallized alumina added in the electro-deposition coating composition in Example 2 was dispersed in an amount of 35 parts by weight, 0.1 part by weight and 0 part by weight, respectively, based on 100 parts by weight of the acrylic melamine resin. Using the same test pieces as those used in Example 1, electro-deposition coating was carried out in each of the above three kinds of electro-deposition coating solutions under the same conditions as in Example 2. After being washed with water, the coatings formed were each washed with water, and then baked in an oven of 97° C.±1° C. for 60 minutes to effect curing. Three kinds of electro-deposition coated members were thus obtained. Here, the amount of codeposition of the metallized alumina was 55 parts by weight, 1 part by weight and 0 part by weight each, based on 100 parts by weight of the electro-deposition coating film.

Next, the respective members were evaluated on their electromagnetic wave shielding effects and coating film properties in the same manner as in Example 2. Results obtained are shown in Table 2.

EXAMPLE 5

An electro-deposition coated member was prepared under the same conditions as in Example 2 except that, using the resin in Example 1, a synthetic mica powder having an average particle diameter of 5 μm whose particle surfaces were subjected to electroless nickel plating was dispersed in an amount of 5 parts by weight.

The resulting member was evaluated on its shielding properties and coating film properties in the same manner as in Example 2. Results obtained are shown in Table 2.

Comparative Example 4

An electro-deposition coated member was prepared in the same manner as in Example 5 except that a synthetic mica powder having an average particle diameter of 8 μm was used.

The resulting member was evaluated on its shielding properties and coating film properties in the same manner as in Example 3. Results obtained are shown in Table 2.

As will be seen from Table 2, the electro-deposition coated members according to the present invention showed very good results in respect of the shielding properties against electromagnetic waves and the coating film properties.

TABLE 2

| | Amount of codeposition (pbw) | Shielding properties (dB) | Coating film properties: Adhesion properties (points) | Wear resistance (times) | Weathering resistance | Moisture resistance (hrs) | Hardness |
|---|---|---|---|---|---|---|---|
| Example: | | | | | | | |
| 2 | 5 | 43 | 8 | 750 | No changes after 600 hrs | 350 | 3H |
| 3 | 25 | 70 | 10 | 830 | No changes after 600 hrs | 350 | 4H |
| 4 | 50 | 90 | 8 | 830 | No changes after 600 hrs | 350 | 5H |
| 5 | 5 | 40 | 8 | 750 | No changes after 600 hrs | 350 | 3H |
| Comparative Example: | | | | | | | |
| 1 | 55 | 90 | 6 | 300 | Cracked after 500 hrs | 300 | 5H |
| 2 | 1 | 35 | 5 | 200 | Color change after 300 hrs | 50 | H |
| 3 | 0 | 30 | 3 | 100 | Color change after 200 hrs | 30 | H |
| 4 | 5 | 35 | 5 | 300 | No changes after 600 hrs | 350 | 3H |

I claim:

1. An electro-deposition coated member comprising a substrate having thereon an electro-deposition coating film wherein said electro-deposition coating film comprises a ceramic powder whose particle surfaces are coated with a metal to provide said film with an electro-conductivity to intercept an electromagnetic noise.

2. An electro-deposition coated member according to claim 1, wherein said electro-deposition coating film has a thickness of from 10 μm to 30 μm.

3. An electro-deposition coated member according to claim 1, wherein said substrate comprises a plastic whose surface has been metal-plated.

4. An electro-deposition coated member according to claim 1, wherein said particle surfaces of the ceramic powder are coated with the metal in a thickness of from 0.05 μm to 3 μm.

5. An electro-deposition coated member according to claim 1, wherein said powder is contained in said electro-deposition coating film in an amount of from 5 to 50 parts by weight based on 100 parts by weight of said electro-deposition coating film.

6. An electro-deposition coated member according to claim 5, wherein the amount of said powder contained in said electro-deposition coating film is from 10 to 30 parts by weight based on 100 parts by weight of said electro-deposition coating film.

7. An electro-deposition coated member for a housing of an electronic machinery, comprising a substrate having thereon an electro-deposition coating film, wherein said electro-deposition coating film comprises a ceramic powder whose particle surfaces are coated with a metal to provide said film with an electro-conductivity to intercept an electromagnetic noise.

8. An electro-deposition coated member according to claim 7, wherein said powder is contained in said electro-deposition coating film in an amount of from 5 to 50 parts by weight based on 100 parts by weight of said electro-deposition coating film.

9. An electro-deposition coated member according to claim 8, wherein said powder is contained in said electro-deposition coating film in an amount of from 10 to 30 parts by weight based on 100 parts by weight of said electro-deposition coating film.

10. An electro-deposition coated member according to claim 7, wherein said electro-deposition coating film has a thickness of from 10 μm to 30 μm.

11. An electro-deposition coated member according to claim 7 wherein said electro-deposition coating film has a thickness of from 10 μm to 30 μm.

12. An electro-deposition coated member according to claim 7, wherein said particle surfaces of the ceramic powder are coated with the metal in a thickness of from 0.05 μm to 3 μm.

13. An electro-deposition coated member according to claim 7, wherein said powder has an average particle diameter of from 0.1 μm to 5. μm.

14. An electro machinery having a housing of an electro-deposition coated member, said electro-deposition coated member comprising substrate having thereon an electro-deposition coating film, wherein said electro-deposition coating film comprises a ceramic powder whose particle surfaces are coated with a metal to provide said film with an electro-conductivity to intercept an electromagnetic noise.

15. An electro machinery according to claim 14, wherein said powder is contained in said electro-deposition coating film in an amount of from 5 to 50 parts by weight based on 100 parts by weight of said electro-deposition coating film.

16. An electro machinery according to claim 15, wherein said powder is contained in said electro-deposition coating film in an amount of from 10 to 30 parts by weight based on 100 parts by weight of said electro-deposition coating film.

17. An electro machinery according to claim 14, wherein said substrate comprises a plastic whose surface has been metal-plated.

18. An electro machinery according to claim 14, wherein said substrate comprises a plastic whose surface has been metal-plated.

19. An electro machinery according to claim 14, wherein said particle surfaces of the ceramic powder are coated with the metal in a thickness of from 0.05 μn to 3 Mm.

20. An electro machinery according to claim 14, wherein said powder has an average particle diameter of from 0.1 μm to 5 μm.

* * * * *

UNITED STATES PATENT AND TRADEMARK OFFICE

CERTIFICATE OF CORRECTION

PATENT NO. : 5,441,818

DATED : August 15, 1995

INVENTOR(S) : SUSUMU KADOKURA

It is certified that error appears in the above-identified patent and that said Letters Patent is hereby corrected as shown below:

ON TITLE PAGE

In [54] Title, line 4, "USE" should read —USED—.

In [56] References Cited, under U.S. PATENT DOCUMENTS,
insert: --4,888,244 12/1989 Nasubuchi et al.
4,844,784 7/1989 Suzuki et al.--.

In [57] ABSTRACT:
Line 11, "of;" should read --of:--.
Line 15, "5 m," should read --5 μm,--.

COLUMN 1

Line 5, "USE" should read --USED--.

COLUMN 3

Line 26, "a" should be deleted.
Line 33, "code position of:" should read --codeposition of--.

COLUMN 5

Line 52, "Give" should read --give--.

COLUMN 9

Line 40, "film" should read --film,--.
Line 65, "comprising" should read --comprising:--.
Line 70 should be deleted.

UNITED STATES PATENT AND TRADEMARK OFFICE

CERTIFICATE OF CORRECTION

PATENT NO. : 5,441,818

DATED : August 15, 1995

INVENTOR(S) : SUSUMU KADOKURA

It is certified that error appears in the above-identified patent and that said Letters Patent is hereby corrected as shown below:

COLUMN 10

Line 17, "claim 7" should read --claim 7,--.
Line 22, "3 µm." should read --3 µm. ¶ 13. An electro-deposition coated member according--.
Line 42, "substrate" should read --a substrate--.
Line 65, "0.05 µn" should read --0.05 µm--.
Line 66, "3 Mm." should read --3 µm.--.

Signed and Sealed this

Twenty-sixth Day of March, 1996

Bruce Lehman

*Attest:*

BRUCE LEHMAN

*Attesting Officer*

*Commissioner of Patents and Trademarks*